United States Patent [19]

Horie et al.

[11] Patent Number: 4,550,821

[45] Date of Patent: Nov. 5, 1985

[54] CIGARETTE REVERSING APPARATUS

[75] Inventors: Motonobu Horie; Toshiyasu Hirabayashi; Hisao Suzuki, all of Tokyo, Japan.

[73] Assignee: The Japan Tobacco & Salt Public Corporation, Tokyo, Japan

[21] Appl. No.: 563,599

[22] Filed: Dec. 20, 1983

[30] Foreign Application Priority Data

Dec. 22, 1982 [JP] Japan ..... 57-224028

[51] Int. Cl.[4] ..... B65G 47/24

[52] U.S. Cl. ..... 198/416; 198/689.1; 198/951

[58] Field of Search ..... 198/951, 689, 402, 403, 198/416

[56] References Cited

U.S. PATENT DOCUMENTS 3,176,825 4/1965 Rudszinat et al. ..... 198/402

3,319,764 5/1967 Gamberini ..... 198/951 X

*Primary Examiner*—Joseph E. Valenza

*Assistant Examiner*—Jonathan D. Holmes

[57] ABSTRACT

A cigarette reversing apparatus comprises a rotating transfer drum having a plurality of openings arranged equidistantly along the circle on the end surface of the drum, the openings being communicated with suction holes formed at the bottom of slots which are formed in the peripheral surface of the drum. A control ring faces the openings in the drum and has a suction distribution chamber spanning a cigarette overturning section of the drum. A rotating ring is slidably and rotatably interposed between the transfer drum and the control ring, the rotating ring being eccentric with respect to the drum and having a plurality of communication holes communicating with both the openings and the suction chamber. The communication holes are arranged equidistantly along a circle at intervals or pitches two times those of openings, the number of communication holes being half of the even number nearest to the odd number of the openings; whereby as the transfer drum makes a complete turn, the rotating ring is rotated at a speed corresponding to ½ pitch of the communication holes faster or slower than the drum so that suction is applied only to the every other slot where the cigarettes are installed so as to overturn the cigarettes efficiently.

8 Claims, 4 Drawing Figures

CIGARETTE REVERSING APPARATUS

BACKGROUND OF THE INVENTION

The present invention relates to an apparatus for reversing the direction of cigarettes and more particularly filter-tipped cigarettes.

Generally, the filter-tipped cigarettes are made as follows. A piece of filter for two cigarettes is inserted between two cigarettes arranged axially; a sheet of paper is wound around them and pasted to form a single bar of cigarette; the cigarette bar is then cut in half at the center of the filter to form two filter-tipped cigarettes.

In the cigarette making machine based on the above principle, two lines of cigarettes oriented in the opposite directions are obtained. For convenience of operations to be done at later processes by the receiving or storage equipment, it is required that the two lines of cigarettes be converted into a single line of cigarettes oriented in the same direction. This provides an important requirement for the present day cigarette making machine and requires one of the two lines of cigarettes to be reversed in direction and combined with the other line of cigarettes into a single line.

One typical equipment that meets the above requirement has the construction in which a plurality of slots are formed in the peripheral surface of the drum and a guide member is provided to raise and set upright the cigarettes being carried in the slots and then overturn them.

This machine has a transfer drum provided with an odd number of slots in the periphery of the drum in a 180° arc. The transfer drum has an inlet for accepting a pair of two opposing cigarettes at a time into each alternate slot. The drum has an outlet for a first line, namely, one of the two lines of cigarettes on the drum. The cigarettes in the second line on the drum are overturned while being carried on the drum through a complete turn. The cigarettes which were overturned and aligned with the first line of cigarettes are taken out from the slots at the outlet.

In this machine, a stationary inclined guide is provided outside the drum, spanning over the cigarette overturning section and a suction hole is formed at the buttom of each slot. The cigarette is overturned with one end held by suction and the other end guided along the inclined guide.

One of the two lines of cigarettes on the drum is transferred from the inlet to the outlet. But the other line of cigarettes is carried by the drum through one complete turn, during which time the cigarettes of the other line are overturned and aligned with the first line of cigarettes. This overturning process is performed continuously and for this purpose, the apparatus is characterized by an odd number of slots which enables the pair of opposite cigarettes to be fed into the every other slot in the drum.

The suction hole for holding one end of the cigarette is provided in each slot. The slots that do not contain the cigarettes to be overturned waste vacuum in the overturning section and the air leaks.

In recent years as the process speed of cigarette making machines is required to be increased, the air leakage has become an important problem. That is, as the rotating speed of the drum increases, the centrifugal force acting on the cigarettes also increases and a higher vacuum pressure is required for holding the reversing cigarettes. There is a growing demand for reduction in the capacity of vacuum source which tends to increase and also for reduction in noise produced from the suction holes that are not holding the cigarettes.

SUMMARY OF THE INVENTION

It is therefore an object of the present invention to provide a high performance cigarette reversing equipment of simple construction which is improved on the above-mentioned conventional equipment and which blocks air suction from the suction holes that are not used to give better hold of the cigarettes being overturned.

The cigarette reversing equipment of this invention comprises: a transfer drum rotating on the stationary shaft and having a plurality of openings arranged equidistantly along the circle on the end surface of the drum, the openings being communicated with suction holes formed at the bottom of the slots which are formed in the peripheral surface of the drum; a control ring rigidly installed facing the openings in the drum and having a suction distribution chamber spanning the cigarette overturning section; and a rotating ring slidably and rotatably interposed between the transfer drum and the control ring, the rotating ring being eccentric with respect to the drum, the rotating ring having a plurality of communication holes communicating with both the openings and the suction chamber, the communication holes being arranged equidistantly along a circle at intervals or pitches two times those of openings, the number of communication holes being half of the even number nearest to the odd number of the openings; whereby as the transfer drum makes a complete turn, the rotating ring is rotated at a speed corresponding to $\frac{1}{2}$ pitch of the communication holes faster or slower than the drum so that the suction is applied only to every other slot where the cigarettes are installed so as to overturn the cigarettes efficiently.

In the above apparatus according to this invention, the transfer drum and the rotating ring rotate at speeds preset individually. For each turn, the communication holes have their engagement phase with the openings advance or lag $\frac{1}{2}$ pitch, with the result that alternate openings are closed blocking suction to every other opening. In practice, the number of openings and communication holes is large and their basic circles are eccentric to each other. So the openings gradually deviate from the positions of the communication holes. It is therefore possible to pass suction air through both the openings and communication holes over an appropriate range of cigarette reversing section by choosing an appropriate hole diameter. The suction air communication range can further be set to an optimum size by providing a suction distribution chamber in the control ring and limiting the application of suction by the suction distribution chamber.

In this way, highly efficient cigarette reversing can be done by applying suction to alternate slots where cigarettes are installed.

DETAILED DESCRIPTION OF THE EMBODIMENTS

Figure 1:
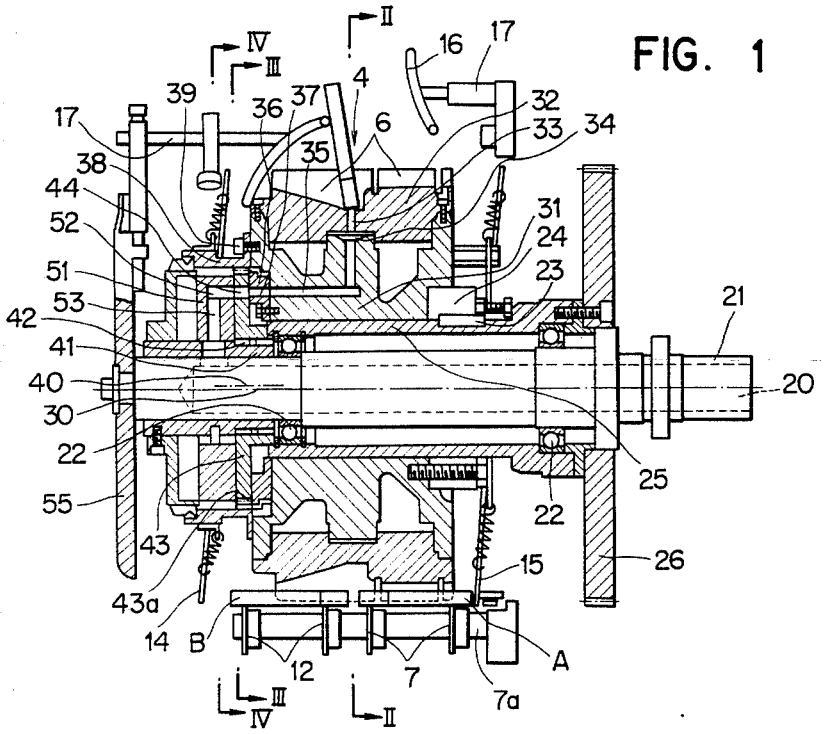
FIG 1 is a front view of an embodiment of this invention showing the cross section.
Figure 2:
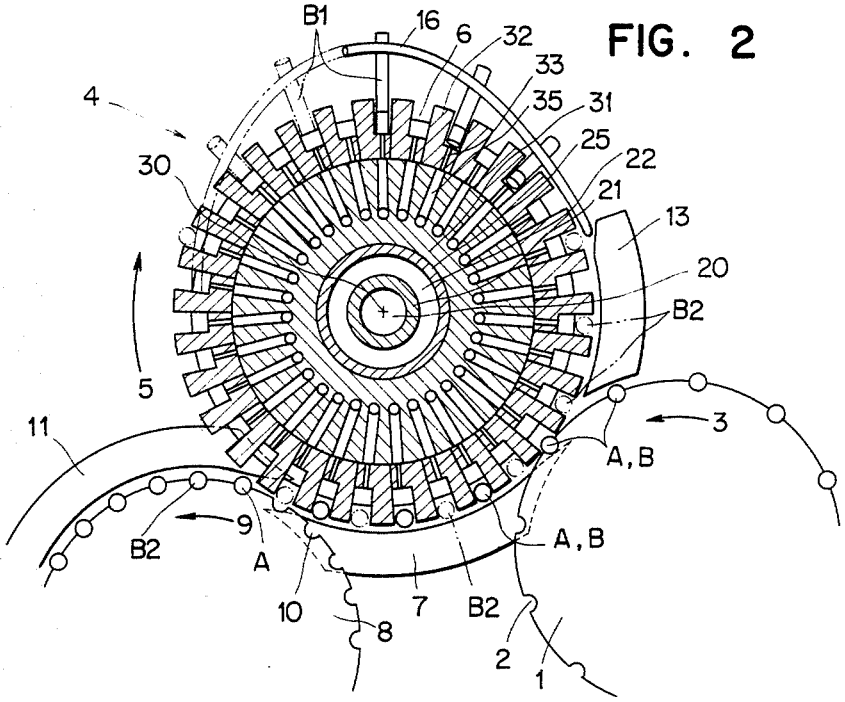
FIGS. 2, 3 and 4 are side cross sections taken along the line II—II, III—III and IV—IV of FIG. 1.

A preferred embodiment of this invention will be explained with reference to the drawings.

A piece of filter for two cigarettes is inserted between a pair of cigarettes and a sheet of paper is wound around them and fixed with paste to form a single bar of cigarette. The cigarette bar is cut in half at the center of the filter to make two filter-tipped cigarettes. The above cigarette making process is done by a means known to the public. In the drawings, cigarette making apparatus is not shown.

A pair of cigarettes A and B, which were formed by cutting a single bar of cigarette at the center of the filter chip and therefore opposite to each other, are accommodated in each stria 2 of the feed drum 1 and then fed to the transfer drum 4. The feed drum 1 is rotating in the direction of arrow 3 and the cigarettes are transferred to the transfer drum 4 which is rotating in the direction of arrow 5.

The feed drum 1 and the transfer drum 4 are arranged so that they turn at the same peripheral speed. The pitch between every adjacent slot 6 formed on the outer periphery of the transfer drum 4 is half the interval between striae 2 of the feed drum 1. This arrangement causes the cigarettes A and B to be fed into every other slot 6 of the transfer drum 4.

As is clearly seen from FIG. 1, the pair of cigarettes A and B in the slots 6 are guided along the opposing stationary guides 7 and 12 provided over the outer periphery of the transfer drum 4. The stationary guides 7 and 12 are secured to a base member through a support member *7a*. The pair of cigarettes A and B are installed opposite to each other in a single slot 6 with the filters in contact. Although the stationary guides 7 and 12 guide both cigarettes A and B, only the guiding action of the stationary guide 7 for cigarettes A is shown for simplicity.

The cigarettes A, after being guided by the stationary guide 7, are taken out from the slots 6 of the transfer drum 4 and further carried by the takeout drum 8 which is rotating in the direction of arrow 9. On the other hand, the cigarettes B are left rotating on the transfer drum 4 to be guided by the stationary guide 12 along an extended arc path.

The takeout drum 8 has grooves 10 in the periphery to receive the cigarettes. The grooves 10 are arranged at the same pitches as those of the slots 6 of the transfer drum 4 and are rotated at the same peripheral speed. Thus, the cigarettes A and the overturned cigarettes B2 (to be described later) are placed on the every other groove 10. To guide the cigarettes on the takeout drum 8 there is provided a guide 11 along the periphery.

Next, the transfer drum 4 is described. The transfer drum 4 is rotatably supported on the stationary shaft 21 through roller bearing 22. The drum body 31 is coupled to the bushing 25 through clamp ring 24 and key 23 and the bushing 25 has a drive gear 26 securely screwed to the extended end thereof.

The drum body 31 is basically a cylindrical drum on the periphery of which is mounted a number of segments 32 by screw each having a slot 6 to install cigarettes. It is important to form an odd number of slots 6 in the drum by arranging the odd number of segments 32.

The part of the bottom of the slot 6 corresponding to the series of cigarettes A is formed horizontal or parallel to the cigarette axis and has a width equivalent to that of a cigarette. For the series of cigarettes B, the slot bottom is inclinedly deep toward the filter end. At the deepest portion of the slot 6, i.e., at the center of the slot length, a suction hole 33 is provided.

The suction holes 33 have these other ends connected to openings at the end surface of the transfer drum 4, that is, to the air hole 35 formed in the drum body 31. In the embodiment shown, a connecting ring 36 is screwed to the end surface of the drum body 31 and air holes 37 formed in the connecting ring 36 opens to the end surface of the body 31. The air holes 37 are arranged equidistantly along the periphery of the drum end surface and are each communicated with the respective slots 6. In the embodiment shown, suction air chambers 34 are provided which are connected to the suction holes 33. The provision of the suction air chambers 34 is advantageous when assembling the segments 32 or when a plurality of suction holes 33 are formed to divide into multiple passages the suction air for holding the cigarette. Normally the division of the suction air is not essential and may be considered only when it is necessary to hold the cigarette more firmly.

A rotating ring or disc member 43 (described later in detail) is slidably mounted on the end surface of the connecting ring 36 and a control ring or disc member 51 is mounted on the end surface of the rotating ring 43 through the rotating ring 43 facing to each other.

Figure 4:
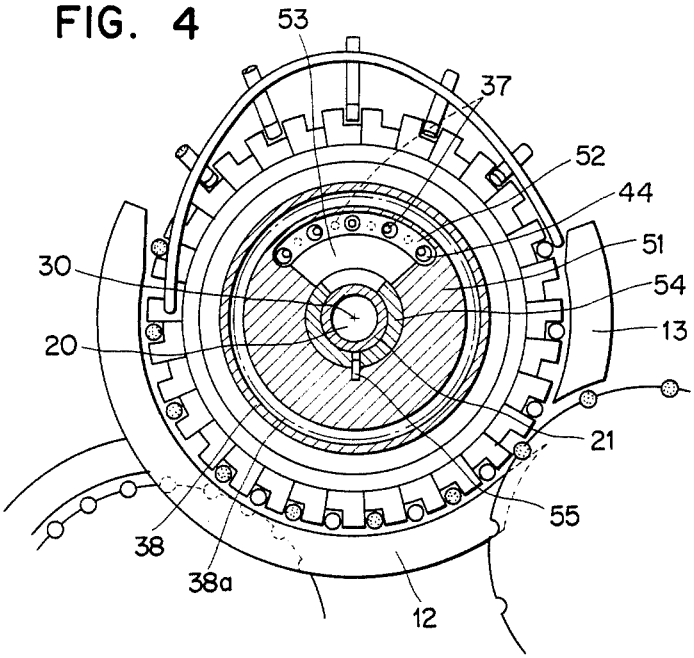

Referring to FIGS. 1 and 4, securely connected to a stationary shaft 21 through bushing 54 and fixing pin 55, the control ring 51 has an end surface on which the rotating ring 43 slides. Opening to the end surface of the control ring 51 is an arc suction distribution chamber 52 formed in the control ring 51. An air passage 53 communicated with the suction distribution chamber 52 passes through the bushing 54 and stationary shaft 21 into a passage 20 formed in the shaft 21. The shaft 21 is a hollow shaft having the passage 20 in the center with the right open end connected to a vacuum source (not shown) and with the other end (where the center passage 20 is connected to the air passage 53) closed.

Figure 3:
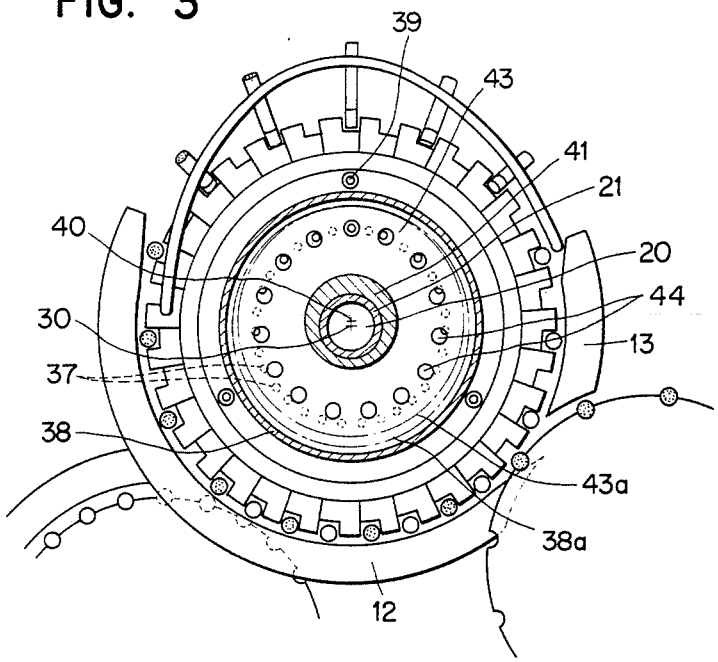

Referring to FIGS. 1 and 3, the action of the rotating ring 43 will be explained. The rotating ring 43 is interposed between the connecting ring 36 mounted to the end surface of the transfer drum 4 and the control ring 51. On the extension of the bushing 54 rigidly mounted on the stationary shaft 21 by fixing pin 55, an eccentric bushing 41 is mounted on the stationary shaft 21 where the rotating ring 43 is to be rotatably supported. The rotating ring 43 is rotatably supported on the eccentric bushing 41 through roller bearing 42. The figures show the rotating centers 30 and 40 of the transfer drum 4 and the rotating ring 43, respectively.

The rotating ring 43 has communication holes 44 cut through it. The communication holes 44 are arranged equidistantly along the circle whose radius coincides, at the 12 o'clock position in the figure, with that of the circle of air holes 37 on the transfer drum 4. The interval of pitch between the communication holes 44 is two times the interval of air holes 37, and the number of communication holes 44 is half of the even number nearest to the odd number of air holes 37 and in this case it is half of one less than the number of air holes 37. The eccentric bushing 41 has such an eccentricity as will provide the above arrangement.

The rotating ring 43 has a gear 43*a* on outer periphery, which is driven by an meshing internal gear member 38 secured to the end surface of the transfer drum 4 by screw 39.

The internal gear 38*a* and the gear 43*a* are shown in mesh at the 12 o'clock position. When the rotating ring 43 is driven by the transfer drum 4, its rotating speed is reasonably high. In other words, as the transfer drum 4 makes one turn, the rotating ring 43 rotates at a speed ½ pitch of communication hole 44 faster than the drum 4. Thus, communication and blocking between the communication holes 44 and the air holes 37 on the transfer drum 4 are alternated every turn of the transfer drum 4.

The diameter of the communication holes 44 and the air holes 37 are set at appropriate size. In a certain rotating arc section before and after the 12 o'clock position of the circle of the communication holes 44 and air holes 37, it is possible to communicate air between these holes over the rotating arc section regardless of whether these hole centers coincide or not. The rotating arc section where the air can be communicated is determined by setting the arc opening of the suction distribution chamber 52 provided in the control ring 51 (see FIG. 4).

As is understood from the embodiment of the communication of air holes 37 by the rotating ring 43, any modification can be made to the rotating ring. For example, it is possible to set the circle of communication holes 44 large compared with that of the air holes 37. In this case the rotating speed ring 43 is decelerated by ½ pitch of the communication hole 44 with respect to the transfer drum 4, thereby providing similar action to the above embodiment.

On the outer periphery of the transfer drum 4, there are provided guide members 14 and 15 not shown in FIG. 4 for simplicity for aligning the axial direction of the cigarettes on the drum 4 and a stationary inclined guide 16 for guiding the cigarettes B to be overturned.

The guide members 14 and 15 face the end surface of the transfer drum 4, extend along the arc orbit of facing slots 6 and are secured to the base members 24 and 38 by support members respectively. The guide members 14 and 15 are mounted at the front and back end surfaced of the trasfer drum 4 to guide the cigarettes B1 to be turned over toward the center of the slot 6, fit one end of the cigarettes B1 to the suction hole 33, guide the overturned cigarettes B2 toward the center of the slot 6, and also to guide one of the lines of cigarettes into the other line of cigarettes A being carried.

The stationary inclined guide 16 for overturning the cigarettes is held by a bar-like member, spanning over the upper half of the transfer drum 4 starting with the end surface on the side of cigarettes B and ending with the other end surface on the side of cigarettes A. The inclined guide, held by a support member 17 on the base 55, guides and lifts one end of the cigarette B1 with the other end supported on the suction hole 33, sending it upright and then turned over.

As is understood from the above construction, of the cigarettes supplied to the transfer drum 4, those B1 to be overturned are held in the slots 6 and carried along the stationary guide 12. In the mean time, the cigarettes B1 contact the guide member 14 at an outer end thereof so that the outer end or inner end is gradually guided toward the center of the slot 6 and finally to the suction hole 33. When the outer end of the cigarette reaches the stationary inclined guide 16, it is lifted up by the inclined guide 16.

The inner end of the cigarette B1 is located at the suction hole 33 in the slot 6 and is therefore subject to the suction of vacuum that acts through the communication hole 44 and air hole 37 connected to the arc suction distribution chamber 52 provided in the control ring 51. The cigarette B1 is thus held at the inner end by the suction of the suction hole 33 while the outer end is being guided along the stationary inclined guide 16, set upright and overturned to the opposite direction. The cigarettes B2 thus turned over are in the line of cigarettes A in the slots 6 and then carried along the stationary guide 13.

When the cigarette reaches this position, it has already passed the arc opening of the suction distribution chamber 52 and hence the suction into the suction hole 33 is blocked with the result that the inner end of the cigarette B2 is released from the holding by suction.

As is seen from the above construction, the suction that held the inner end of the cigarette B1 during the process of overturning the cigarette acts on the suction holes 33 in the alternate slots 6. In this way the cigarettes B1 to be overturned are installed in the alternate slots 6 on suction holes 33 which communicate to the vacuum source.

When the cigarettes B2 installed in every other slot 6 have made a complete turn around the transfer drum 4 and pass the supply position of the feed drum 1, they do not come to the exact feeding position of the cigarettes A and B from the feed drum 1. That is, the number of slots 6 is odd and the slot that has come to the feeding position at this time is the vacant slot adjacent to the one where the overturned cigarette B2 in question is installed.

The cigarettes A supplied from the feed drum 1 and the overturned cigarettes B2, both being arranged alternately and aligned in the same direction, are passed onto the takeout drum 8.

As described in the foregoing, with the apparatus of this invention it is possible to apply suction for holding one end of the cigarettes only to alternate slots where the cigarettes are installed and block it for the slots where no cigarettes are installed. In this way highly efficient overturning of cigarettes can be performed by applying suction only to the cigarettes to be overturned and holding them by suction.

What is claimed is:

1. A cigarette reversing apparatus comprising a transfer drum (4) rotating in a predetermined direction and having first and second axial ends, said transfer drum having an odd number of slots (6) axially extending in a periphery thereof with regular spacings therebetween, said slots each being divided substantially at respective middle points thereof into first and second sections to receive plural pairs of cigarettes in which cigarettes in each pair are aligned butt to butt, said transfer drum having a plurality of air holes (35) formed therewithin corresponding in number to the slots in the periphery thereof and having first openings (33) in said slots at said respective middle points thereof and second openings (37) in the first axial end, said second openings in the first axial end, being circularly arranged in said second axial end at regular spacings therebetween;

feed means for feeding plural pairs of cigarettes to said transfer drum each at an interval two times each of said regular spacings between the slots such that each pair is received in the first and second sections of every other slot in the transfer drum periphery;

take-up means provided downstream of said feed means for taking up cigarettes received in the second sections of the slots at a predetermined take-up position;

reversing means provided between upstream of said take-up means and downstream of said feed means for reversing cigarettes received in the first sections of the slots about said middle points to transfer said cigarettes into the second section;

a rotating disc member (43) slidably abutting against said first axial end and having a plurality of communication holes (4) axially extending therewithin, said communication holes being circularly arranged at regular angular spacings therebetween, each angular spacing between two adjacent communication holes being two times each angular spacing between two adjacent second openings (37) of the air holes (35) in the transfer drum, said rotating disc member rotating about a center eccentric from the center of the transfer drum to bring the communication holes into alignment with every other second opening only at an angular area where said reversing means extends, said every other second opening communicating with the slots in which the cigarettes are being reversed; and vacuum source means for providing vacuum to said communication holes.

2. A cigarette reversing apparatus according to claim 1, wherein said transfer drum (4) is supported rotatably on a stationary shaft (21), said transfer drum and said stationary shaft having a common axis (30).

3. A cigarette reversing apparatus according to claim 2, wherein said stationary shaft carries an eccentric bushing (41) providing an axis (40) on a reversing means side of said common axis, said rotating disc member (43) being rotatably supported on said eccentric bushing.

4. A cigarette reversing apparatus according to claim 3, wherein said transfer drum (4) has an internal gear member (38) secured to the first end thereof, said rotating disc member (43) having a diameter smaller than said internal gear member (38) such that said rotating disc member is in mesh with said internal gear only on the reversing means side thereof.

5. A cigarette reversing apparatus according to claim 4, wherein said circular arrangement of the communication holes (44) provides a smaller diametrical size than the circular arrangement of the second openings (37).

6. A cigarette reversing apparatus according to claim 2, wherein said stationary shaft (21) has a longitudinal bore (20) therein connected to said vacuum source means, said stationary shaft having a control disc member (51) mounted thereon, said control disc member having an arc-shaped air distribution chamber (52) formed therein in communication with said communication holes (44) on a reversing means side thereof, said control disc member and said stationary shaft (21) having air passages (53 and 21') to communicate said arc-shaped air distribution chamber with said longitudinal bore in the stationary shaft.

7. A cigarette reversing apparatus according to claim 1, wherein said feed means includes a feed drum (1) having a plurality of slots (2) axially extending in a periphery thereof at spacings each two times each of said regular spacings between the slots (6) in the transfer drum periphery and provided in a vicinity of the transfer drum opposite said transfer drum periphery to supply cigarettes to the transfer drum at a predetermined supply position.

8. A cigarette reversing apparatus according to claim 1, wherein said take-up means includes a take-up drum (8) having a plurality of slots (10) axially extending in a periphery thereof at spacings each corresponding to each of said regular spacings between the slots (6) and provided in a vicinity of the transfer drum opposite said second section of the slots (6) in the transfer drum periphery to receive cigarettes from the transfer drum at a predetermined take-up portion.

* * * * *